US008555801B1

(12) United States Patent
Rudwal et al.

(10) Patent No.: US 8,555,801 B1
(45) Date of Patent: Oct. 15, 2013

(54) WATERCRAFT HELM SUPPORT STRUCTURE AND DECK

(75) Inventors: Christopher Rudwal, Outremont (CA); Christian Lepine, Bromont (CA); Philippe Petit, Orford (CA); Joey Larouche, Mont-Saint-Hilaire (CA); Sam Spade, Palm Bay, FL (US); Pierre Rondeau, St-Denis-de-Brompton (CA); Richard Simard, St-Charles-de Drummond (CA); Etienne Girard, Orford (CA); Rick Adamczyk, St-Cloud, FL (US)

(73) Assignee: Bombardier Recreational Products Inc., Valcourt (CA)

( * ) Notice: Subject to any disclaimer, the term of this patent is extended or adjusted under 35 U.S.C. 154(b) by 244 days.

(21) Appl. No.: 13/101,684

(22) Filed: May 5, 2011

Related U.S. Application Data

(60) Provisional application No. 61/437,712, filed on Jan. 31, 2011.

(51) Int. Cl.
*B63B 17/00* (2006.01)

(52) U.S. Cl.
USPC ..... 114/343; 114/364

(58) Field of Classification Search
USPC ..... 114/144 R, 343, 352, 363, 364
See application file for complete search history.

(56) References Cited

U.S. PATENT DOCUMENTS

| | | | | |
|---|---|---|---|---|
| 3,707,938 | A | | 1/1973 | Olson |
| 3,726,249 | A | | 4/1973 | Watkins |
| 3,756,189 | A | | 9/1973 | Yutzler |
| 3,948,206 | A | | 4/1976 | Tyler |
| 4,694,770 | A | | 9/1987 | Kitner et al. |
| 4,893,579 | A | | 1/1990 | Kobayashi |
| 4,945,852 | A | | 8/1990 | Kobayashi |
| 5,076,190 | A | | 12/1991 | Iikawa |
| 5,113,777 | A | | 5/1992 | Kobayashi |
| 5,255,626 | A | | 10/1993 | Hattori et al. |
| D349,740 | S | | 8/1994 | Tabor |
| 5,390,621 | A | | 2/1995 | Hattori et al. |
| 5,520,133 | A | | 5/1996 | Wiegert |
| 5,542,371 | A | | 8/1996 | Harvey et al. |
| 5,697,317 | A | | 12/1997 | Pereira |
| 5,813,357 | A | | 9/1998 | Watson |
| 6,019,054 | A | * | 2/2000 | Hattori et al. ..... 114/55.57 |
| 6,152,062 | A | * | 11/2000 | Hattori ..... 114/343 |
| 6,422,168 | B1 | | 7/2002 | Kobayashi |
| 6,892,666 | B1 | | 5/2005 | Plante et al. |
| 7,004,091 | B2 | | 2/2006 | Adamczyk et al. |

(Continued)

FOREIGN PATENT DOCUMENTS

| | | |
|---|---|---|
| WO | 8801587 | 3/1988 |
| WO | 9400339 | 1/1994 |

*Primary Examiner* — Daniel Venne
(74) *Attorney, Agent, or Firm* — BCF LLP

(57) ABSTRACT

A watercraft has a hull and a deck disposed above the hull. A helm assembly disposed above the deck has a steering column and a handlebar. A pedestal is disposed on the deck at least in part rearwardly of the handlebar. A support structure bears the helm assembly. The support structure surrounds at least in part the steering column. The support structure has at least one rear connection portion connected to the pedestal. The support structure has at least one front connection arm connected to at least one of the deck and the hull forwardly from the at least one rear connection portion. A watercraft with a deck having at least two portions is also presented.

11 Claims, 12 Drawing Sheets

(56) References Cited

U.S. PATENT DOCUMENTS

| | | | |
|---|---|---|---|
| 7,124,703 | B2 | 10/2006 | Richard et al. |
| 7,124,847 | B2 | 10/2006 | Girouard et al. |
| 7,124,848 | B2 | 10/2006 | Girouard et al. |
| 7,188,573 | B2 | 3/2007 | Hirabara |
| 7,188,693 | B2 | 3/2007 | Girouard et al. |
| 7,314,014 | B2 | 1/2008 | Heyring et al. |
| 7,357,090 | B2 | 4/2008 | Spade et al. |
| 7,377,348 | B2 | 5/2008 | Girouard et al. |
| 7,469,764 | B2 | 12/2008 | Girouard et al. |
| 2008/0110385 | A1 | 5/2008 | Nakatsuji et al. |
| 2010/0132602 | A1 | 6/2010 | Pereira |

* cited by examiner

WATERCRAFT HELM SUPPORT STRUCTURE AND DECK

CROSS-REFERENCE

The present application claims priority to U.S. Provisional Patent Application No. 61/437,712, filed Jan. 31, 2011, and entitled "Watercraft Helm Support Structure and Deck", the entirety of which is incorporated herein by reference.

TECHNICAL FIELD

The present invention relates to structures for supporting helm assemblies of watercraft and decks of watercraft.

BACKGROUND

Referring to FIGS. 1A and 1B, a watercraft 10 is made of a hull 4 and a deck 3. The hull 4 and deck 3 are joined together at a seam (not shown) generally covered with a bumper 11. The deck 3 is integrally formed of a sprayed fiberglass. The hull 4 and the deck 3 form a volume which accommodates an engine 12 (shown schematically). A central portion of the deck 3 forms a pedestal 21. A centrally positioned straddle-type seat 20 is positioned on top of the pedestal 21 to accommodate a rider (and possibly a passenger) in a straddling position. When the driver is seated on the seat 20, the driver may use a front portion 23 of the pedestal 21 to secure his/her knees against it.

The watercraft 10 has a pair of generally upwardly extending walls located on either side of the watercraft 10 known as gunwales or gunnels 56. A reboarding platform 32 is provided at a rear 90 of the watercraft 10 on the deck 3 to allow the rider or a passenger to easily reboard the watercraft 10 from the water. The watercraft 10 is provided with a hood 58 (shown spaced from the watercraft 10 in FIG. 1A) located at a front 92 of the watercraft 10. The hood 58 provides an access to a large storage compartment 25. In some cases the storage compartment 25 is omitted.

A helm assembly 46 is provided forwardly of the straddle seat 20. The helm assembly 46 comprises a steering column 22 and a handlebar 24 (left and right steering handles). The helm assembly 46 has a central helm portion 72, which is padded. One of the steering handles 24 is provided with a throttle operator 50, which allows the rider to control the engine 12, and therefore the speed of the watercraft 10. The other of the steering handles 24 is provided with a lever 51 used by the driver to control a jet propulsion system (not shown). A display area or cluster (not shown) is usually located forwardly of the helm assembly 46. The central helm portion 72 also contains various buttons (not shown), which could alternatively be in the form of levers or switches, that allow the rider to modify the display data or mode (speed, engine rpm, time . . . ) on the display cluster. The helm assembly 46 may include more elements than the ones recited above.

A front portion 60 of the deck 3 supports the helm assembly 46. The front portion 60 is shaped to support the weight of the helm assembly 46 and of the driver leaning on it, as well as to define a top of the large storage compartment 25. The front portion 60 extends and tapers forward to a bow 64 of the watercraft 10. The helm assembly 46 is secured to the front portion 60 of the deck 3 at a rear of the front portion 60 by a fixation assembly 62. The fixation assembly 62 surrounds the steering column 22.

The deck 3 is a unitary piece constructed to be sturdy enough to sustain the greatest local load. Hence the deck is thick and heavy even at places where it does not need to be. Additionally, the large front portion 60 in the current watercraft 10 induces unnecessary weight of the watercraft 10, which for some watercraft limits the driving capabilities of the watercraft.

Therefore, there is a need for a deck and watercraft components that could be adapted to the reparation of loads on the watercraft.

SUMMARY

It is an object to ameliorate at least some of the inconveniences present in the prior art.

It is also an object to provide a structure supporting the helm assembly that would be lighter. The structure is compact and can be connected to the deck or the hull. Because of its compactness, a front of the watercraft is being freed up compared to the prior art and the overall weight of the watercraft is decreased.

It is another object to provide a deck made of at least two portions connected to each other. A rear portion of a deck typically does not sustain the same forces than a middle portion of the deck. For example, the reboarding platform is used only at times for reboarding a user, while the middle portion supports the pedestal and the helm assembly at all times. However, the prior art decks are formed of a single piece. The deck provided herein is made of at least two portions, so that each portion can, if desired, be made of different material or materials with different characteristics. As a result, the deck may be constructed to be lighter than in the prior art.

In one aspect, a watercraft is provided. The watercraft comprises a hull, and a deck disposed above the hull. A helm assembly is disposed above the deck. The helm assembly has a steering column, and a handlebar connected to the steering column. A pedestal is disposed on the deck at least in part rearwardly of the handlebar. A straddle seat is disposed on the pedestal. A support structure is bearing the helm assembly. The support structure surrounds at least partially the steering column. The support structure has at least one rear connection portion connected to the pedestal. The support structure has at least one front connection arm connected to at least one of the deck and the hull forwardly from the at least one rear connection portion.

In an additional aspect, the support structure includes a first portion and a second portion. The first portion includes the at least one rear connection portion. The first portion surrounds the steering column. The second includes the at least one front connection arm. The first portion is connected to the second portion.

In a further aspect, the support structure is disposed generally forward of the pedestal.

In an additional aspect, the at least one front connection arm connects to the at least one of the deck and the hull forwardly of the handlebar.

In a further aspect, the at least one front connection arm extends forwardly from the at least one rear connection portion.

In an additional aspect, the at least one rear connection portion extends rearwardly from at least one of the handlebar and the steering column, and the at least one front connection arm extends forwardly from at least one of the handlebar and the steering column.

In a further aspect, the at least one front connection arm includes a left connecting arm and a right connecting arm.

In an additional aspect, the support structure is removably connected to the pedestal and to the at least one of the deck and the hull.

In a further aspect, the support structure and at least one of the deck and the pedestal define an aperture extending transversally through the watercraft.

In an additional aspect, the support structure includes at least one ventilation hose fluidly connected to an engine compartment of the watercraft.

In a further aspect, the deck includes at least two deck portions connected to each other. Each of the at least two deck portions includes at least a portion of a side of the deck in contact with the hull, and each of the at least two deck portions rest on the hull.

In another aspect, a watercraft is provided. The watercraft comprises a hull, and a deck disposed above the hull. The deck has at least three sides in contact with the hull. A helm assembly is disposed above the deck. The helm assembly has a steering column, and a handlebar connected to the steering column. A pedestal is disposed on the deck at least in part rearwardly of the handlebar. A straddle seat is disposed on the pedestal. The deck includes at least two deck portions connected to each other. Each of the at least two deck portions includes at least a portion of at least one of the at least three sides of the deck. Each of the at least two deck portions rests on the hull.

In an additional aspect, connections between the at least two deck portions are located along raised portions of the deck.

In a further aspect, the at least two deck portions have different structural resistances.

In an additional aspect, each the at least two deck portions includes at least a portion of two sides of the at least three sides of the deck.

In a further aspect, only one of the at least two deck portions supports the pedestal and the helm assembly.

In an additional aspect, the at least two deck portions includes a front portion at a bow of the watercraft, and a rear portion at an aft of the watercraft. A middle portion is disposed between the front portion and the rear portion. Connections between the front, middle and rear portions are disposed generally transversally along the deck.

In a further aspect, a support structure is supported by the middle portion. The support structure bears the helm assembly. The support structure surrounds at least partially the steering column. The support structure has at least one rear connection portion connected to the pedestal. The support structure has at least one front connection arm connected to the middle portion of the deck forwardly from the at least one rear connection portion.

For purposes of this application, terms related to spatial orientation such as forwardly, rearwardly, left, and right, are as they would normally be understood by a rider or a driver of the vehicle sitting thereon in a normal riding position.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION

Figure 1A:
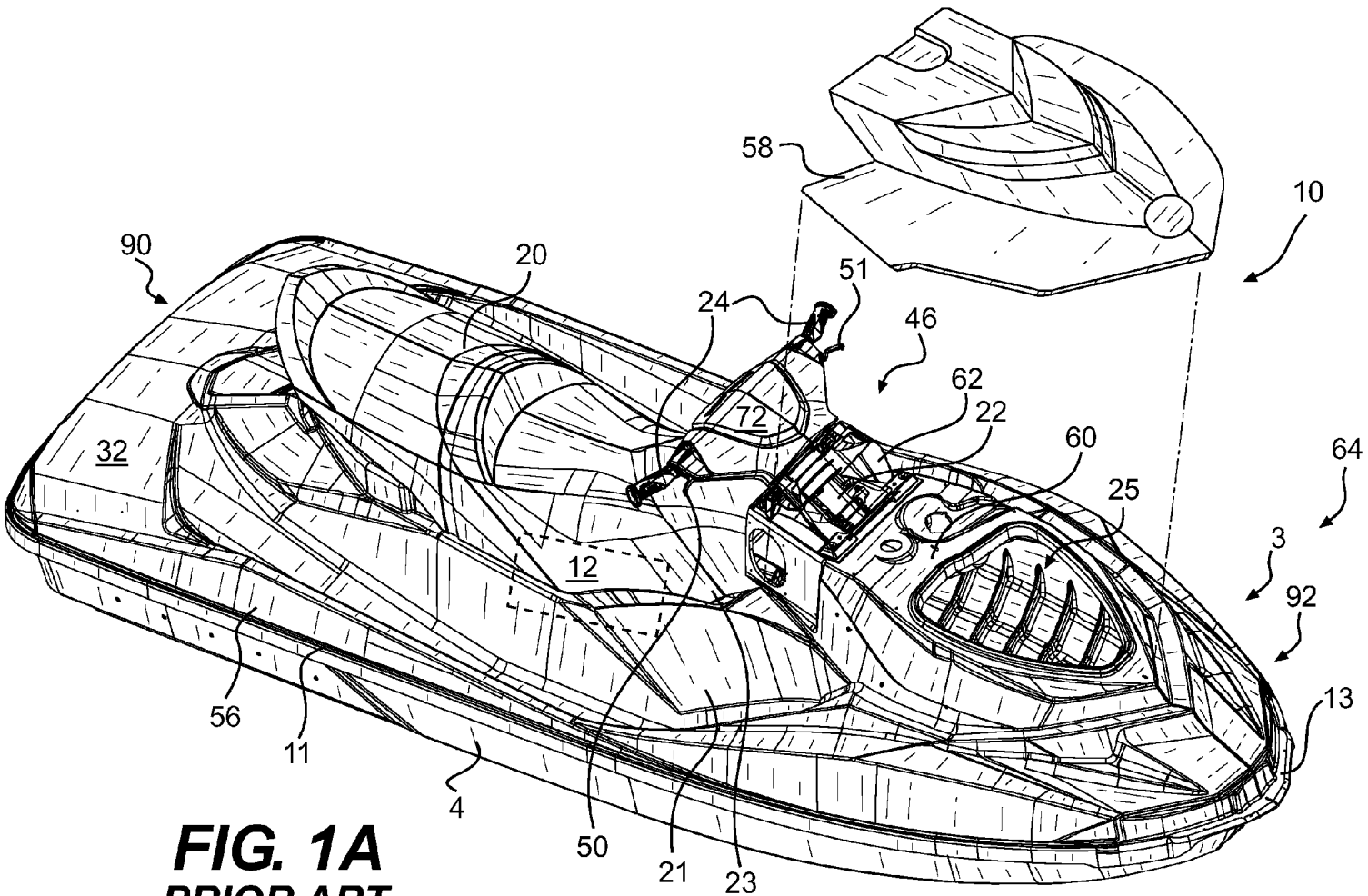
FIG. 1A PRIOR ART
FIG. 1A is a perspective view taken from a front, right side of a prior art personal watercraft.
Figure 1B:
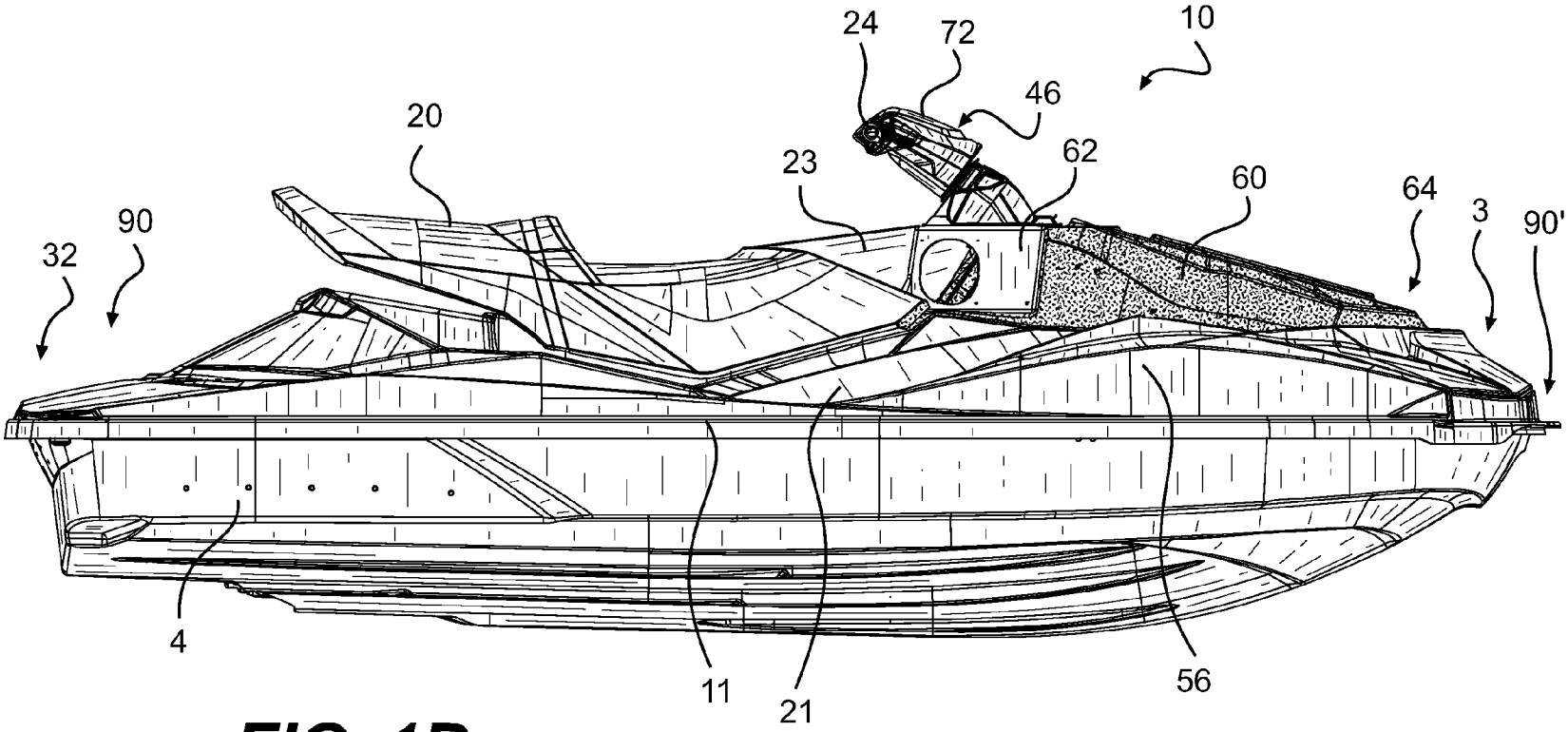
FIG. 1B PRIOR ART
FIG. 1B is a right side elevation view of the prior art watercraft of FIG. 1A with the hood removed for clarity.

Referring to FIGS. 2 to 5, a personal watercraft (hereinafter called watercraft) 100 having a helm support structure 200 and a deck 300 will be described.

The personal watercraft 100 is made of two main parts: a hull 104 and a deck 300 disposed on the hull 104. The hull 104 buoyantly supports the watercraft 100 in the water. The deck 300 is designed to accommodate a driver and, in some cases, one or more passengers. The hull 104 and deck 300 are joined together at a bond line (not shown) by fasteners. Rivets, bolts, snaps or an adhesive may also be used to join the hull 104 to the deck 300. A bumper 110 generally covers the bond line, which helps to prevent damage to an outer surface of the watercraft 100 when the watercraft 100 is docked. A front 192 of the watercraft 100 includes a front bumper 113. The volume created between the hull 104 and the deck 300 is known as the engine compartment. The engine compartment accommodates an engine 112 (shown schematically in FIG. 4) as well as other elements required by or desired for the watercraft 100. The deck 300 includes three distinct portions: a front deck portion 302 at the front 192 of the watercraft 100, a rear deck portion 306 at a rear 190 of the watercraft 100, and a middle deck portion 304 between the front deck portion 302 and the rear deck portion 306. The deck 300 is made of a thermoplastic. The deck 300 will be described in greater detail below. The hull 104 is made of a unitary piece of thermoplastic. The thermoplastic is a composite of propylene and a filler that represents 30 percent in weight. It is contemplated that the filler for the thermoplastic of the hull 104 could represent between 10 and 40 percent in weight.

The deck 300 has a pedestal 121 on top of which a straddle seat 120 is centrally positioned. The straddle seat 120 accommodates the driver in a straddling position. The pedestal 121 is located at the middle deck portion 304. The pedestal 121 is integrally formed with the deck 300, and made of the same thermoplastic as the middle deck portion 304. It is contemplated that the pedestal 121 could be fastened to the middle deck portion 304. It is contemplated that the pedestal 121 could be removably connected to the deck 300.

The straddle seat 120 is preferably removably attached to the pedestal 121 by a hook and tongue assembly (not shown) at a front of the straddle seat 120 and by a latch assembly (not shown) at the rear of the straddle seat 120. It is contemplated that the straddle seat 120 could be attached to the pedestal 121 by other attachment mechanisms. It is also contemplated that the seat 120 could not be removable. The straddle seat 120 covers an engine access opening (not shown), defined by a top portion of the pedestal 121, which provides access to the engine 112. A grab handle may be provided between the pedestal 121 and the straddle seat 120 at a rear of the straddle seat 120 to provide a handle onto which a passenger may hold on.

The watercraft 100 has a pair of generally upwardly extending walls, known as gunwales or gunnels 156, located on either side of the watercraft 100. The gunnels 156 help to discourage the entry of water in the watercraft 100, provide lateral support for the driver's feet, and also provide buoyancy when turning the watercraft 100. Optionally, the gunnels 156 could extend inwardly to act as heel rests towards the rear 190 of the watercraft 100.

Located on either side of the straddle seat 120, between the pedestal 121 and the gunnels 156, are a pair of footrests 130. The footrests 130 are designed to accommodate the driver's feet in various riding positions. The footrests 130 may be covered by carpeting made of a rubber-type material to provide additional comfort and feet traction for the rider.

A reboarding platform 132 is provided at the rear 190 of the watercraft 100 to allow the rider or a passenger to easily reboard the watercraft 100 from the water. Carpeting may also cover the reboarding platform 132. A retractable ladder may be affixed to a transom 160 to facilitate boarding the watercraft 100 from the water onto the reboarding platform 132.

A helm assembly 146 is positioned forwardly of the straddle seat 120. The helm assembly 146 includes a steering column 122, and a pair of steering handles (or handlebar) 124. A central helm portion 172 of the helm assembly 146 is padded. It is contemplated that the padding could be omitted. The right steering handle of the handlebar 124 is provided with a throttle lever 126 allowing the rider to control the speed of the watercraft 100, and the left steering handle of the handlebar 124 with a lever 150 to control a position of a reverse gate (not shown). It is contemplated that the handlebar 124 could include a steering wheel. It is contemplated that the lever 150 and the reverse gate could be omitted. Optional display clusters could be located on the helm assembly 146. The helm assembly 146 is also provided with a key receiving post 147, located near a center of the central helm portion 172. The key receiving post 147 is adapted to receive a key attached to a lanyard so as to allow starting of the watercraft 100. It is contemplated that the key receiving post 147 may be placed in any other suitable location on the watercraft 100.

Unlike in the watercraft 10 of the prior art where the helm assembly 46 was supported directly by the deck 3 at the front portion 60, the helm assembly 146 in the watercraft 100 is supported by a helm support structure 200 distinct from the deck 300. As best shown when comparing FIG. 1B to FIG. 4, where the front portion 60 and helm support structure 200 are shown in dark shading, the helm support structure 200 is a less bulky, more compact structure than the front portion 60 and the pedestal 121 is shorter than the pedestal 21. The helm support structure 200 does not define a large storage compartment in the deck 300 like the front portion 60 does. Also, the helm support structure 200 has only a discrete number (3) of weight bearing attachment points (or surfaces), as opposed to the prior art front portion 60 which is inducing a continuous weight bearing line on the rest of the deck 3. The helm support structure 200 will be described in greater detail below.

Figure 4:
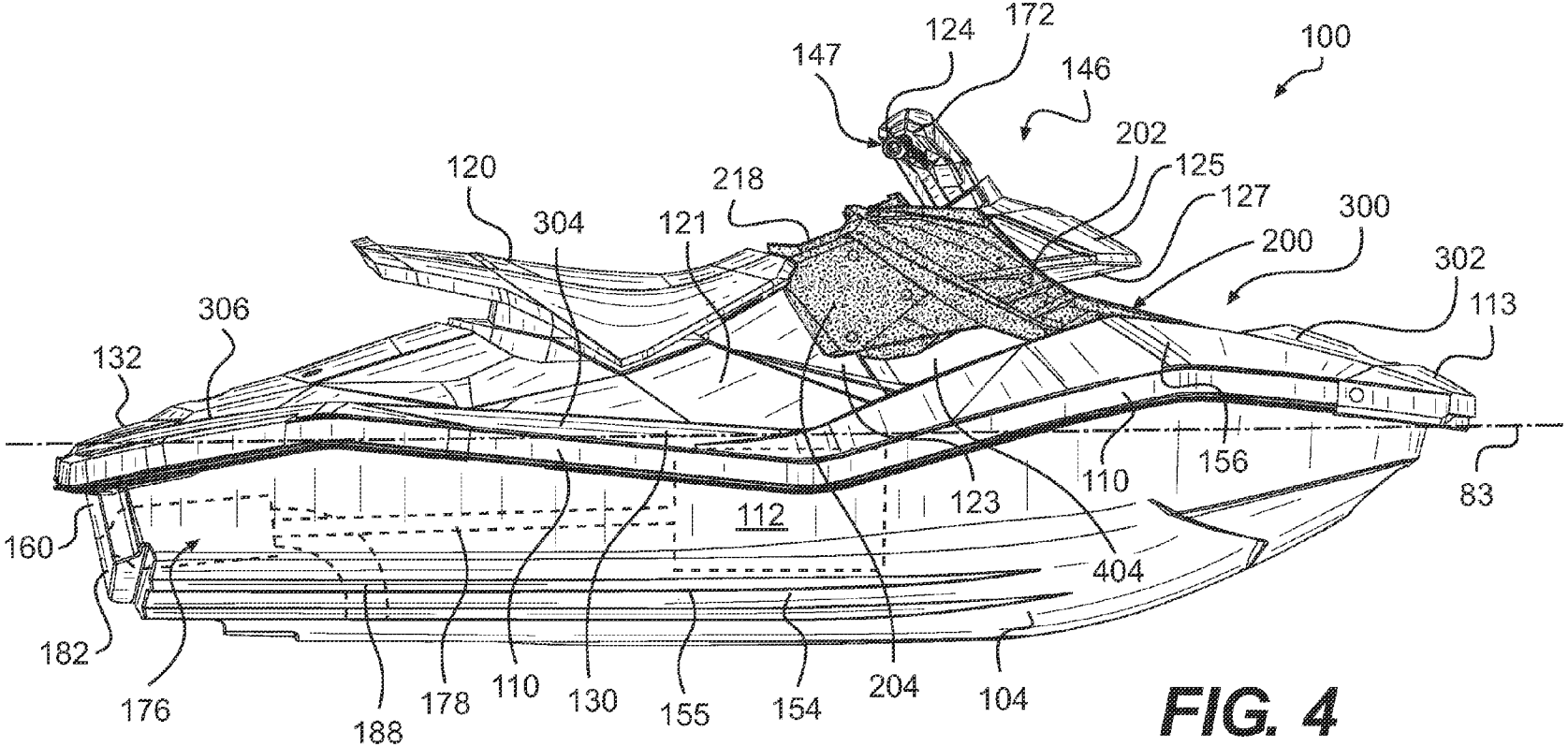
FIG. 4 is a right side elevation view of the personal watercraft of FIG. 2 with a helm support structure shown shaded.

As best seen in FIG. 4, the hull 104 is provided with a combination of strakes 154 and chines 155. A strake 154 is a protruding portion of the hull 104. A chine 155 is the vertex formed where two surfaces of the hull 104 meet. It is this combination of strakes 154 and chines 155 that will give the watercraft 100 its riding and handling characteristics.

Sponsons may be located on either sides of the hull 104 near the transom 160. The sponsons have an arcuate undersurface, which give the watercraft 100 both lift while in motion and improved turning characteristics. The sponsons may be integrally formed with the hull 104.

The watercraft 100 is propelled by a jet pump 176. It is contemplated that other types of propulsion systems, such as propellers, could also be used. The jet pump 176 pressurizes water and accelerates it to create thrust. The water is first scooped from under the hull 104 through an inlet grate (not shown). The inlet grate prevents large rocks, weeds, and other debris from entering the jet pump 176 since they may damage it or negatively affect its performance. Water then flows through a water intake ramp 188. The top portion of the water intake ramp is preferably formed by hull 104 and the ride shoe (not shown) forms its bottom portion. Alternatively, the intake ramp 188 may be a single piece to which the jet pump 176 attaches. In such cases, the intake ramp and the jet pump 176 are attached as a unit in a recess in the bottom of hull 104. From the intake ramp 188, water then enters the jet pump 176. The jet pump 176 is located in what is known as the tunnel (not shown). The tunnel is opened towards the rear, and is defined at the front, sides, and top by the hull 104, and at the bottom by a ride plate (not shown). The ride plate is the surface on which the watercraft 100 rides or planes. The jet pump 176 is made of two main parts: the impeller (not shown) and the stator (not shown). The impeller is coupled to the engine 112 by one or more shafts 178, such as a driveshaft and an impeller shaft. The rotation of the impeller pressurizes the water, which then moves over the stator that is made of a plurality of fixed stator blades (not shown). The role of the stator blades is to decrease the rotational motion of the water so that most of the energy imparted to the water is used for thrust, as opposed to swirling the water. Once the water leaves the jet pump 176, it goes through the pump nozzle (not shown). Since the pump nozzle's exit diameter is smaller than its entrance diameter, the water is accelerated further, thereby providing more thrust. A steering nozzle 182 is pivotally attached to the pump nozzle through a vertical pivot point. The steering nozzle 182 is operatively connected to the helm assembly 146 via a push-pull cable (not shown) such that when the helm assembly 146 is turned, the steering nozzle 182 pivots, redirecting the water coming from the pump nozzle, so as to steer the watercraft 100 in the desired direction. In some watercraft, the steering nozzle 182 may be gimbaled to allow it to move around a second horizontal pivot axis. The up and down movement of the steering nozzle 182 provided by this additional pivot axis is known as trim, and controls the pitch of the watercraft 100.

As previously mentioned, the watercraft 100 is provided with a reverse gate. The reverse gate is pivotally attached to the sidewalls of the tunnel, directly on the pump nozzle, or directly on the steering nozzle 182. To make the watercraft 100 move in a reverse direction, the rider pulls on the lever 150 operatively connected to the reverse gate. The reverse gate then pivots in front of the steering nozzle 182 and redirects the water leaving the jet pump 176 towards the front of the watercraft 100, thereby thrusting the watercraft 100 rearwardly. It is contemplated that the reverse gate could be omitted.

Figure 6:
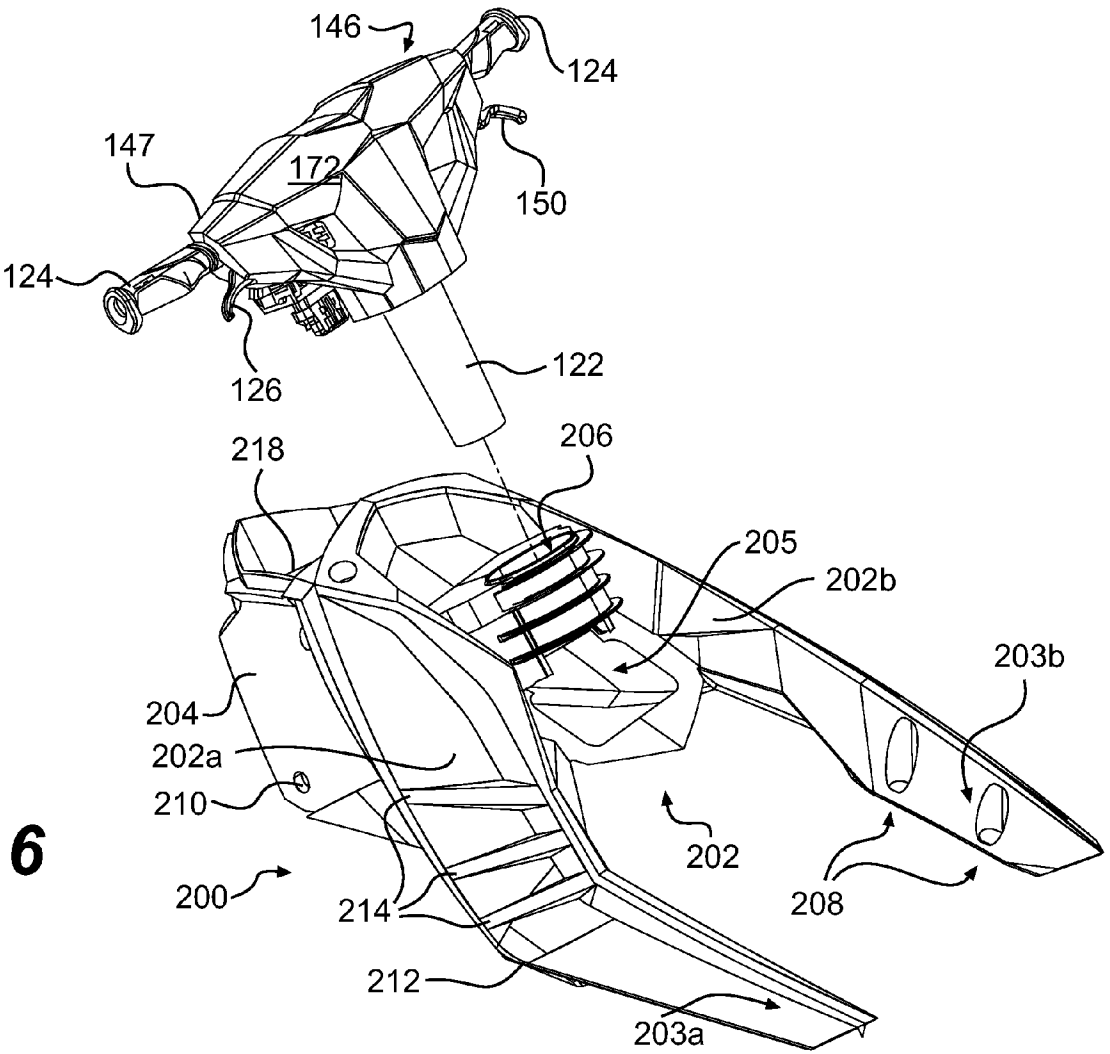
FIG. 6 is an exploded perspective view, taken from a front, right side of a helm support structure and a helm assembly for the watercraft of FIG. 2.
Figure 7:
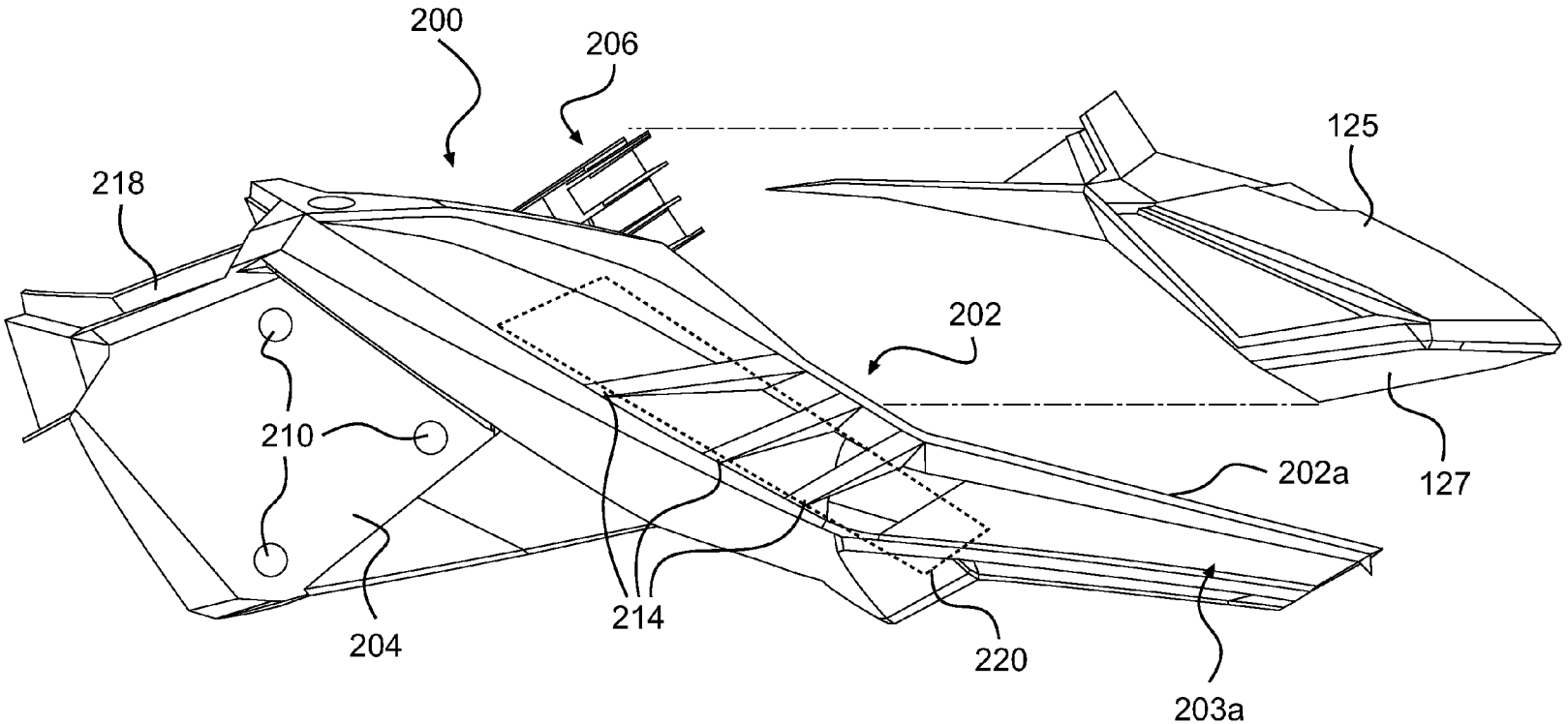
FIG. 7 is an exploded right side view of the helm support structure of FIG. 6 and of a storage compartment for the watercraft of FIG. 2.

Referring now in particular to FIGS. 6 and 7, a first embodiment of the helm support structure 200 will be described in greater detail.

The helm support structure 200 is a structure for supporting the helm assembly 146 (steering column 122, handlebar 124 and optionally display gauges, mirror, buttons and clusters). As will be described below, the helm support structure 200 also accommodates some internal components of the watercraft 100. The helm support structure 200 is distinct from the pedestal 121 and the deck 300, and is removably connected to the pedestal 121 and the deck 300. It is contemplated that the helm support structure 200 could be integrally formed with the deck 300 and/or the pedestal 121. In the embodiments shown in the Figures, the helm support structure 200 is positioned forward of the pedestal 121. However, it is contemplated that the pedestal 121 and the helm support structure 200 could substantially overlap each other.

The helm support structure 200 has a rear connection portion 204 which connects to the pedestal 121, and a front connection portion 202 which connects to the deck 300. The front connection portion 202 and the rear connection portion 204 will be described in more detail below. A first aperture 206 (shown in FIG. 6) located between the front connection portion 202 and the rear connection portion 204 receives an upper part of the steering column 122. A second aperture 205 located vertically below receives a lower part of the steering column 122. The steering column 122 is inserted into the apertures 206, 205. Bearings are located at each aperture 206, 205, to allow the steering column 122 to be rotated. Flanges (not shown) abut the steering column 122 for preventing the steering column 122 to slide away from the apertures 206, 205.

The helm support structure 200 is a unitary piece of the same thermoplastic as the one used for the pedestal 121 and the middle deck portion 304. It is contemplated that the helm support structure 200 could be made of a material different from the one of the pedestal 121 or the deck 300. It is also contemplated that the helm support structure 200 could be made of a material other than a thermoplastic. For example, the helm support structure 200 could be made of fiberglass only, or could be made of aluminum. It is also contemplated that the helm support structure 200 could be formed of two or more portions, and that some of these portions could be integrally formed with the deck 300 and/or the pedestal 121. For example, the helm support structure 200 could be made of a first portion connected to the pedestal 121 and surrounding the steering column 122, and of a second portion connected to the first portion and to the hull 104 or the deck 300.

Figure 5:
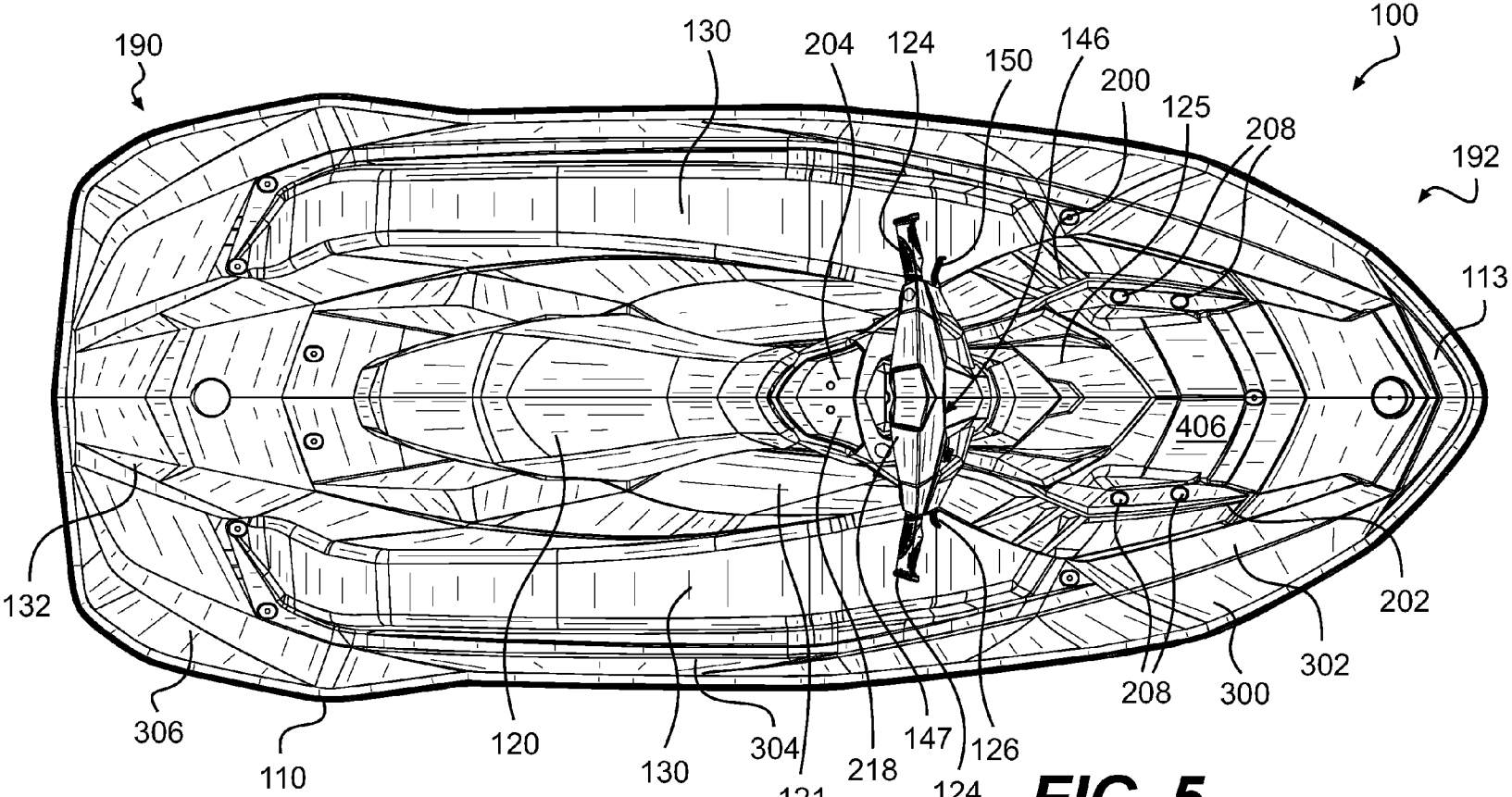
FIG. 5 is a top view of the personal watercraft of FIG. 2.
Figure 8:
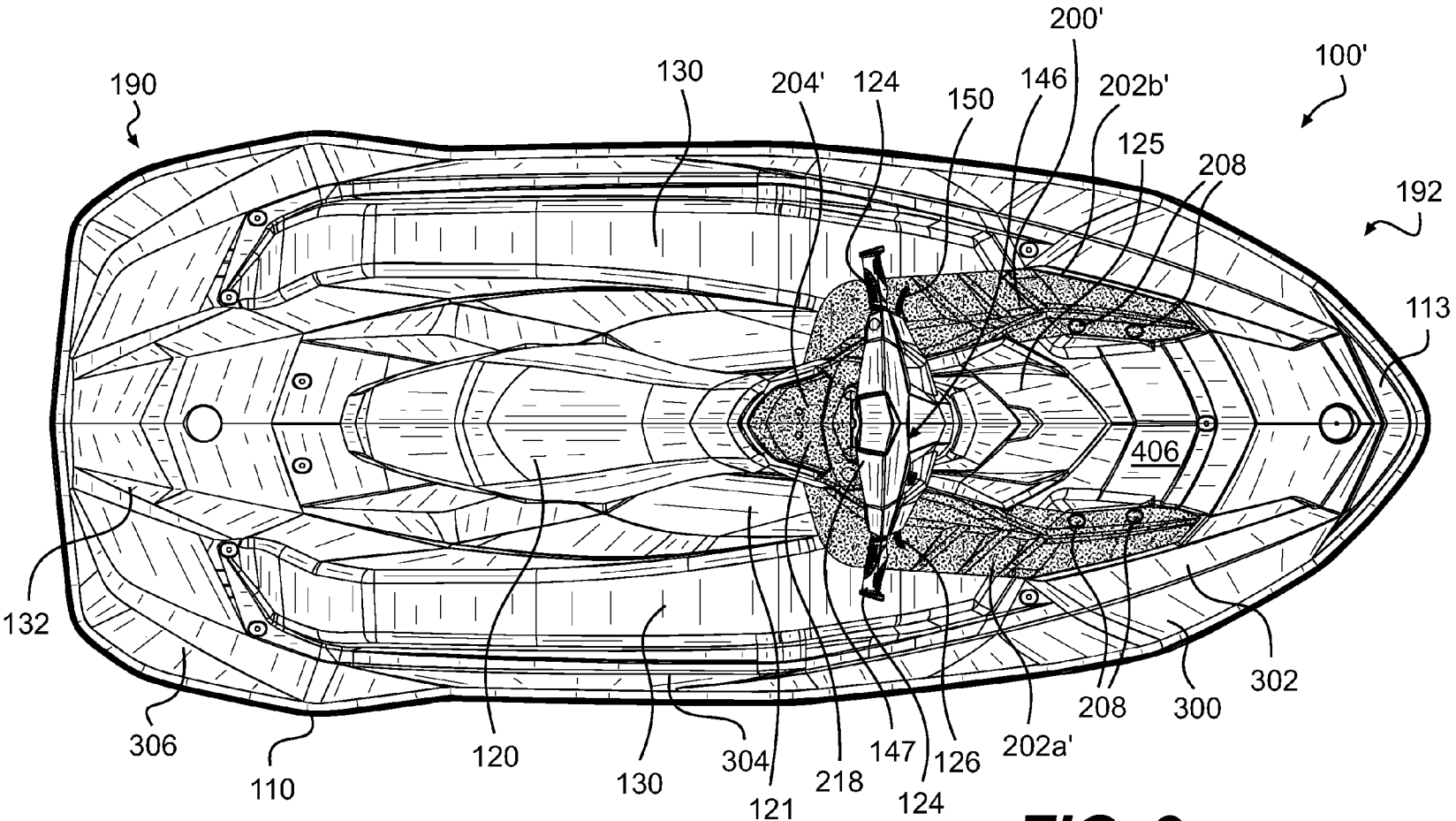
FIG. 8 is a top view of a second embodiment of a personal watercraft with a helm support structure shown shaded.
Figure 9:
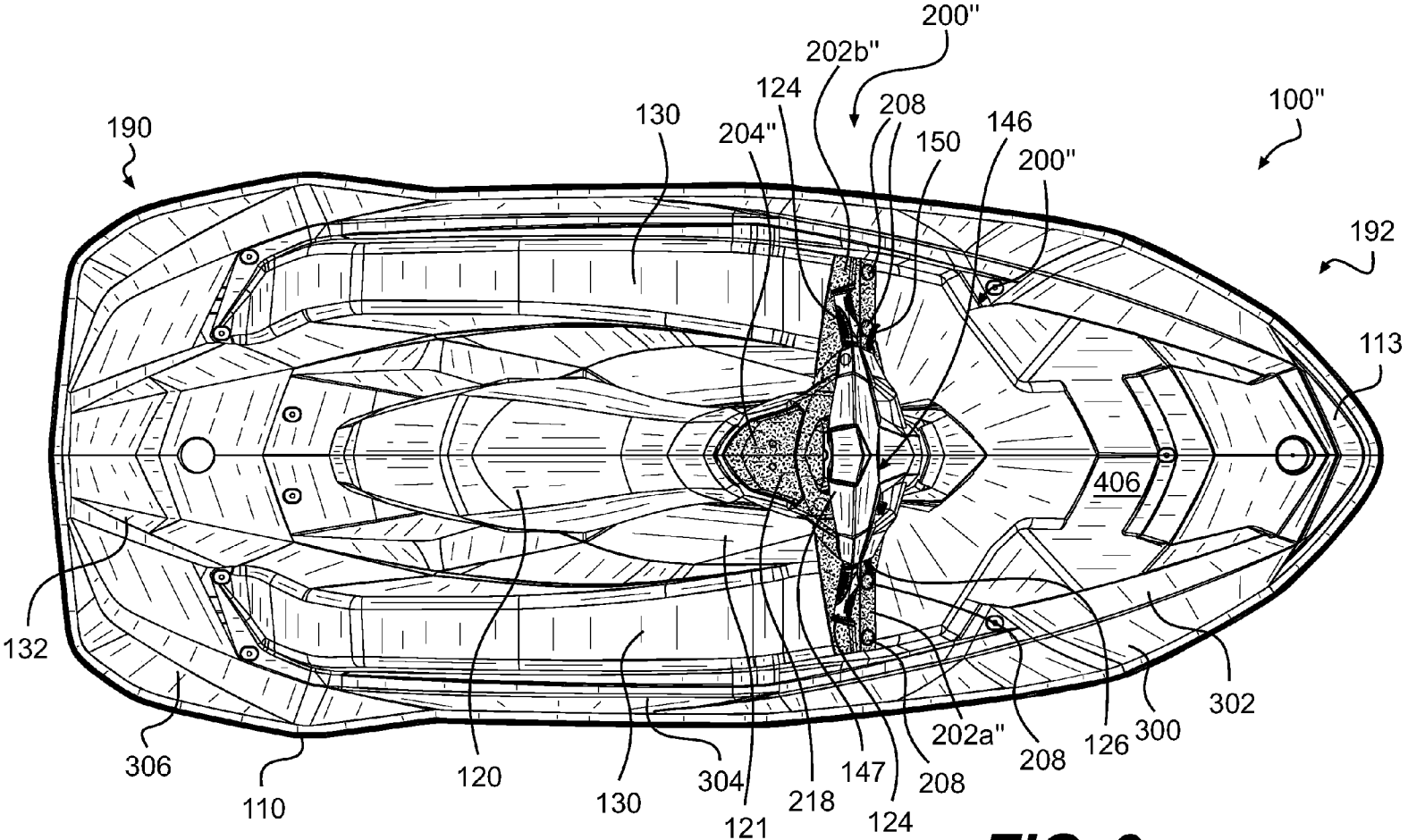
FIG. 9 is a top view of a third embodiment of a personal watercraft with a helm support structure shown shaded.

The front connection portion 202 will first be described. The front connection portion 202 includes right and left front connection arms 202*a,b*. The front connection arms 202*a,b* provide a more compact design than the front portion 60 of the deck 3 that supports the helm assembly 46 of the prior art watercraft 10. This also allows to reduce the weight of the watercraft 100, as well as to create openings for water to flow from sides to sides of the watercraft 100. For example, as seen in FIG. 4, when seen from a side, the deck 300, a front 123 of the pedestal 121 and the helm support structure 200 define an opening 404 which goes through the watercraft 100. It is contemplated that the front connection portion 202 could have only one or more than two front connection arms 202*a,b*. As best shown in FIG. 5, the front connection arms 202*a,b* are disposed forward of the rear connection portion 204 and of the handlebar 124. It is contemplated that the front connection arms 202*a,b* could be disposed at least in part rearwardly of the handlebar 124. For example, in a second embodiment shown in FIG. 8, a watercraft 100' has a support structure 200' with front connection arms 202*a,b'* disposed forward of a rear connection portion 204', yet a portion is disposed rearward of the handlebar 124. It is also contemplated that the front connection arms 202*a,b* could extend forwardly from the steering column 122. It is also contemplated that the front connection arms 202*a,b* could be disposed sideways across the deck 300. In a third embodiment shown in FIG. 9, a watercraft 100" has a support structure 200" with front connection arms 202*a,b"* disposed forward of a rear connection portion 204", yet extending sideways from the rear connection portion 204".

The front connection arms 202*a,b* attach to the deck 300 by bolts (not shown) inserted into apertures 208. Rubber washers (not shown) are disposed under flat washers at the apertures 208 between the bolts and the front connection arms 202*a,b* to ensure waterproof connection to the deck 300. It is contemplated that the front connection portion 202 could be connected to the deck 300 by way other than with bolts, and that waterproofing could be achieved other than with rubber washers. For example, the front connection portion 202 could be glued or riveted to the deck 300. It is also contemplated that the front connection portion 202 could not be connected waterproofly to the deck 300. It is contemplated that the front connection arms 202*a,b* could each have only one or more than two apertures to connect to the deck 300.

Figure 10:
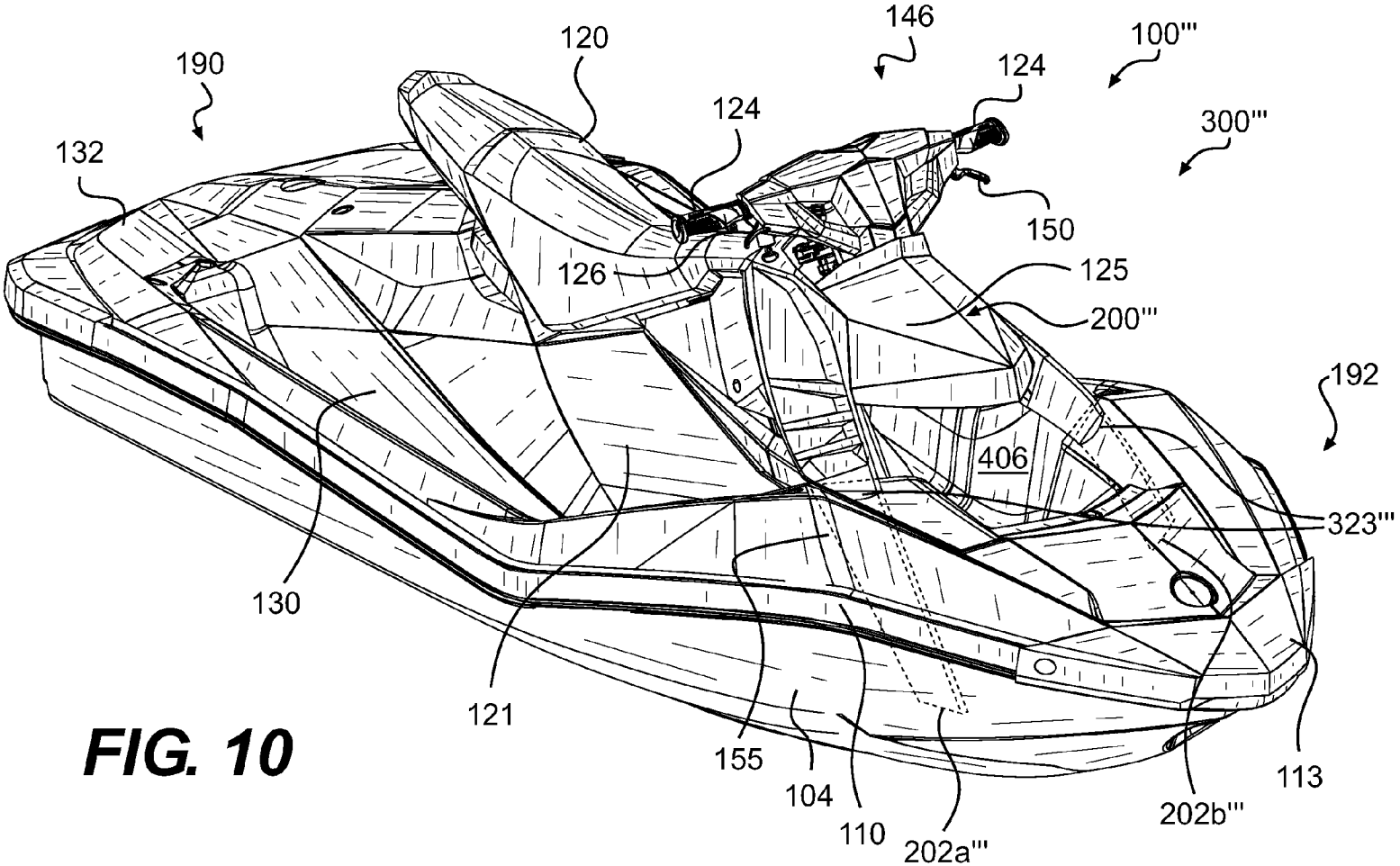
FIG. 10 is a perspective view, taken from a front, right side of a fourth embodiment of a personal watercraft.
Figure 11:
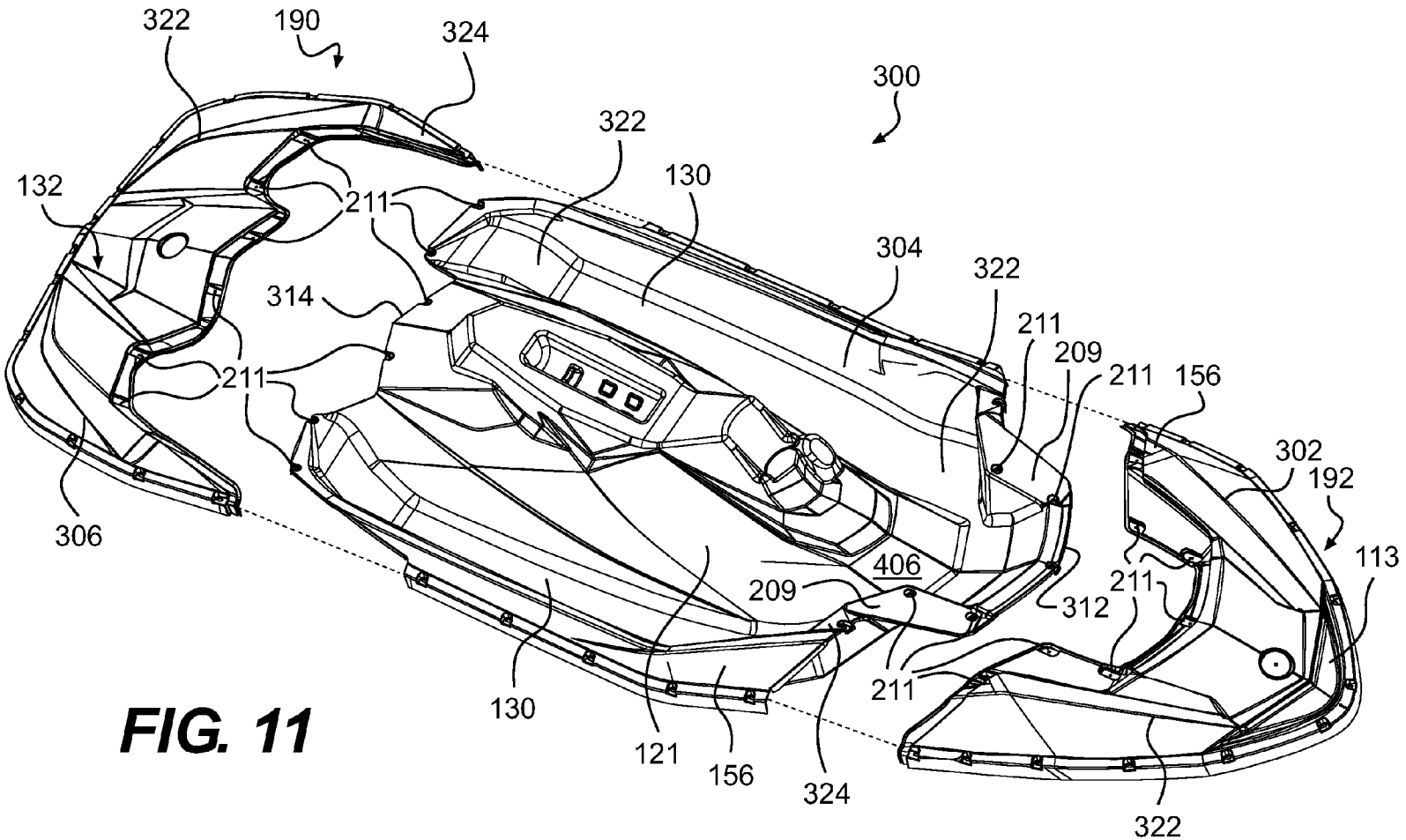
FIG. 11 is an exploded perspective view, taken from a top, right side of a deck of the personal watercraft of FIG. 2.

The front connection arms 202*a,b* connect to a front edge of the middle deck portion 304 of the deck 300 at connection surfaces 209 (shown in FIG. 11). It is contemplated that the front connection arms 202*a,b* could connect somewhere else on the deck 300. It is also contemplated that the front connection arms 202*a,b* could connect at a location other than on the deck 300. For example, in a fourth embodiment shown in FIG. 10, a watercraft 100''' has a helm structure support 200''' with front connection arms 202*a,b'''* attaching to an inside surface of the hull 104. A deck 300''' has apertures 323''' to allow the front connection arms 202*a,b'''* to reach the hull 104. The apertures 323''' are sealed so as to be waterproof.

The front connection arms 202*a,b* are bent at bends 212 (shown in FIG. 6). The bends 212 allow contact portions 203*a,b* of the front connection arms 202*a,b* to be parallel to the middle deck portion 304 so as to provide a contact surface with the middle deck portion 304. The contact portions 203*a,b* connect to the middle deck portion 304 at the connection surfaces 209 (shown in FIG. 11). It is contemplated that the front connections arms 202*a,b* could each have more than one bend 212, and that the bends 212 could be omitted. It is contemplated that the front connection portion 202 could have only one connection arm, or could have more than two connection arms.

The front connection arms 202*a,b* have reinforcement ridges 214. The reinforcement ridges 214 allow to have a lighter construction of the front connection arms 202*a,b*. It is contemplated that the reinforcement ridges 214 could be omitted.

The front connection arms 202*a,b* are hollow and receive each in their interior a ventilation hose 220 (shown schematically in FIG. 7). The ventilation hose 220 supplies the engine compartment with ambient air and vent the engine compartment. It is contemplated that the ventilation hoses 220 could be only partially surrounded by the front connection arms 202*a,b*, or could be disposed adjacent to the front connection arms 202*a,b*. It is also contemplated that the ventilation hoses 220 could be located elsewhere on the watercraft 100.

The rear connection portion 204 will now be described. The rear connection portion 204 extends rearwardly from the aperture 206 to attach to the front 123 of the pedestal 121. Sides of the rear connection portion 204 also serve as a surface on which the user can secure his/her knees while driving, similarly to the front portion 23 of the pedestal 21 of the prior art watercraft 10. As mentioned above, the pedestal 121 is shorter than the prior art pedestal 21 due to the presence of the rear connection portion 204. It is contemplated that the pedestal 121 could be of a same length as the prior art pedestal 21. It is contemplated that the rear connection portion 204 could be longer or shorter than shown in the Figures depending on a size of the pedestal 121. It is contemplated that the rear connection portion 204 could feature only sides or only a top.

The rear connection portion 204 has a general U-shape congruent with the front 123 of the pedestal 121. Only a rearward end of the rear connection portion 204 connects to the pedestal 121. An inside of the U-shape is hollow and is used to store electrical components (not shown) of the watercraft 100. The electrical components include the ones linked to the steering column 122 (e.g. steering angle sensor, electrical harness connectors), controls of the steering (if any) and the optional display gauges. It is contemplated that more or less than the above could be stored in the rear connection portion 204. A plate (not shown) removably attached to a bottom of the U-shape of the rear connection portion 204 covers the electrical components and protects them from exterior elements. It is contemplated that the rear connection portion 204 could connect to the seat 120. It is also contemplated that the rear connection portion 204 could have a shape different than the one shown in the Figures. For example, in embodiments where the pedestal 121 extends forwardly toward the handlebar 124, as the prior art pedestal 21 does, the rear connection portion 204 would be reduced to a connection at the steering column 122, and would not (or only shortly) extend rearwardly from the steering column 122. It is contemplated that the rear connection portion 204 could not receive the electrical components. It is also contemplated that the rear connection portion 204 could overlap entirely with the pedestal 121.

The rear connection portion 204 has six apertures 210 (three on each side) to receive bolts (not shown) so as to connect to the pedestal 121. It is contemplated that the rear connection portion 204 could have more or less than six apertures to connect to the pedestal 121. A rubber washer is disposed under a flat washer between the bolts and the rear connection portion 204 to ensure waterproof connection to the pedestal 121 at the apertures 210. It is contemplated that the rear connection portion 204 could be connected to the pedestal 121 by way other than with bolts, and that waterproofing could be achieved other than with rubber washers. For example, the rear connection portion 204 could be glued or riveted to the pedestal 121. It is also contemplated that the rear connection portion 204 could not be connected waterproofly to the pedestal 121. A top of the rear connection portion 204 includes a small storage 218 for storing personal items, such as keys.

The helm support structure 200 is designed to support the weight of the helm assembly 146 (and of the driver if he/she leans on the handlebar 124), and forces resulting from accelerations of the watercraft 100. The front connection arms 202*a,b* and the rear connection portion 204 form a tripod. The central helm portion 172 is located at the summit of the tripod. It is contemplated that the helm support structure 200 could have a shape other than a tripod.

As best seen in FIG. 7, the helm support structure 200 also supports a front compartment 125, removably connected to a front of the helm support structure 200. The front compartment 125 is clipped to the helm support structure 200. It is contemplated that the front compartment 125 could be attached by means other than clips to the helm support structure 200. For example, the front compartment 125 could be bolted to the helm support structure 200. It is also contemplated that the front compartment 125 could be fixedly connected to or integrally formed with the helm support structure 200. It is also contemplated that the front compartment 125 could be omitted. The front compartment 125 surrounds a portion of the steering column 122. It is contemplated that the front compartment 125 could not surround the steering column 122. The front compartment 125 is made of a same thermoplastic as the helm support structure 200. The front compartment 125 is closed at its bottom by a removable plate 127 which protects electrical components of the watercraft 100 which are located in the front compartment 125 from being damaged by the exterior. It is contemplated that the front compartment 125 could be made of a different material.

Referring to FIG. 11, the deck 300 will now be described in greater detail. As mentioned earlier, the deck 300 is made of three portions: the front deck portion 302, the rear deck portion 306, and the middle deck portion 304 disposed between the front deck portion 302 and the rear deck portion 306.

The front deck portion 302 extends forward of the helm support structure 200, and bears its own weight. The middle deck portion 304 includes the footrests 130, the gunnels 156, and the pedestal 121, all integrally formed with the middle deck portion 304. When assembled onto the watercraft 100, the middle deck portion 304 bears a weight of the seat 120, helm support structure 200, helm assembly 146 and optionally the driver and/or a passenger. The rear deck portion 306 extends rearward of the pedestal 121, and bears its own weight. It is contemplated that the deck 300 could be made of less or more than three deck portions. The deck portions 302, 304, 306 are connected to each other along generally transverse seams 312 and 314. It is contemplated that the deck portions 302, 304, 306 could be left, right and center deck portions connected to each other along generally longitudinal seams. It is also contemplated that seams between deck portions could be a combination of lateral and transverse seams. It is contemplated that the seams could be neither transverse nor lateral. For example, the seams could be disposed at an angle so that the deck portions are triangles or trapezes. It is contemplated that more than one deck portion could bear the weight of the seat 120, the helm support structure 200, and the helm assembly 146. For example, the left front connection arm 202*b* of the helm support structure 200 could be connected to a left deck portion, and the right front connection arm 202*a* of the helm support structure 200 could be connected to a right deck portion. As can be seen, the seams 312, 314 are not straight. It is contemplated that the seams 312, 314 could be straight.

The deck portions 302, 304, 306 are structural deck portions and are connected to each other by bolts (not shown) inserted into holes 211. It is contemplated that the deck portions 302, 304, 306 could be connected by other means than bolts. For example, the deck portions 302, 304, 306 could be glued or riveted. The connections along seams 312, 314 are waterproof. A rubber washer is disposed where the bolts are located. It is contemplated that the seams 312, 314 could be waterproofed by means other than a rubber washer.

Figure 2:
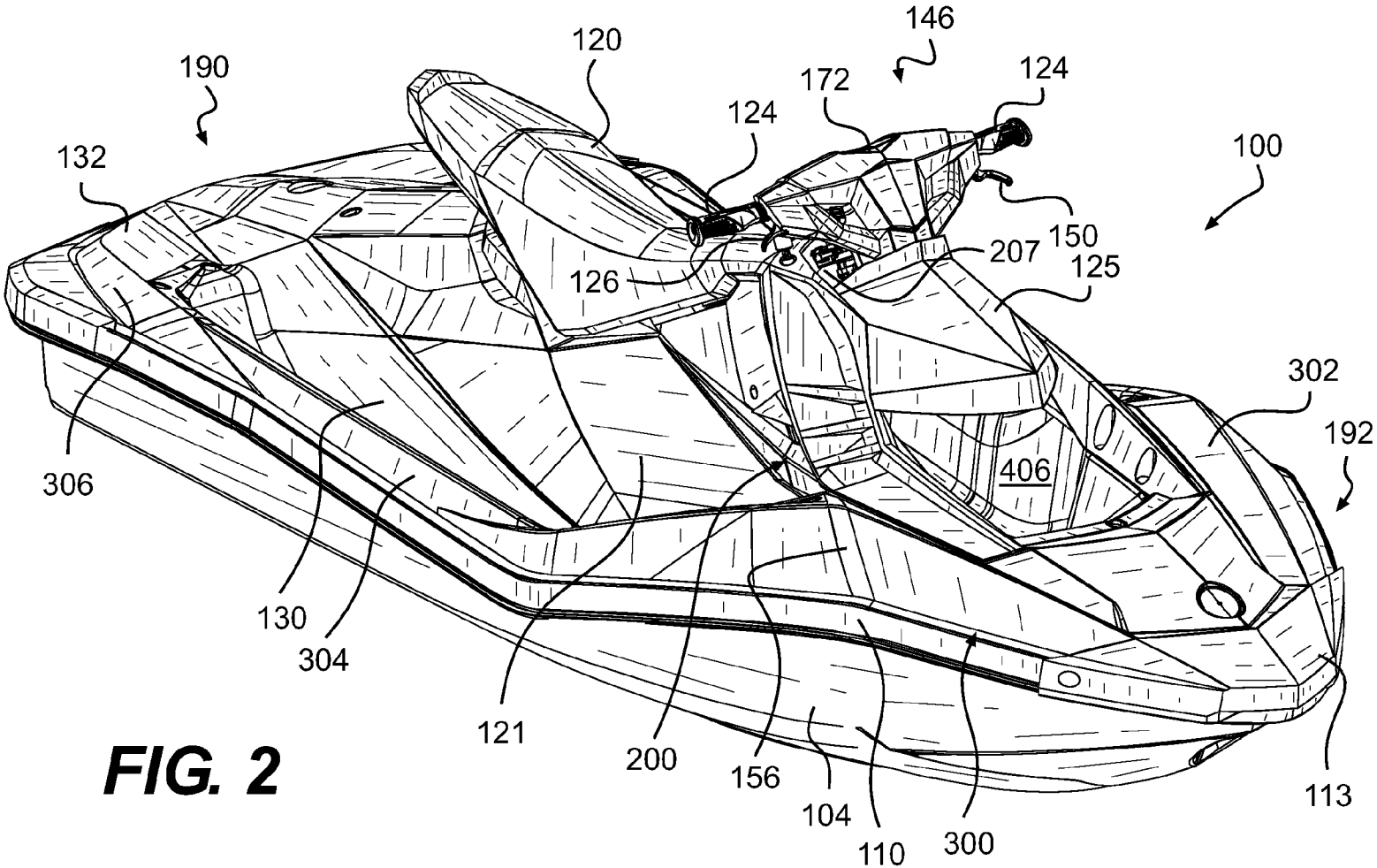
FIG. 2 is a perspective view, taken from a front, right side of a first embodiment of a personal watercraft.
Figure 3:
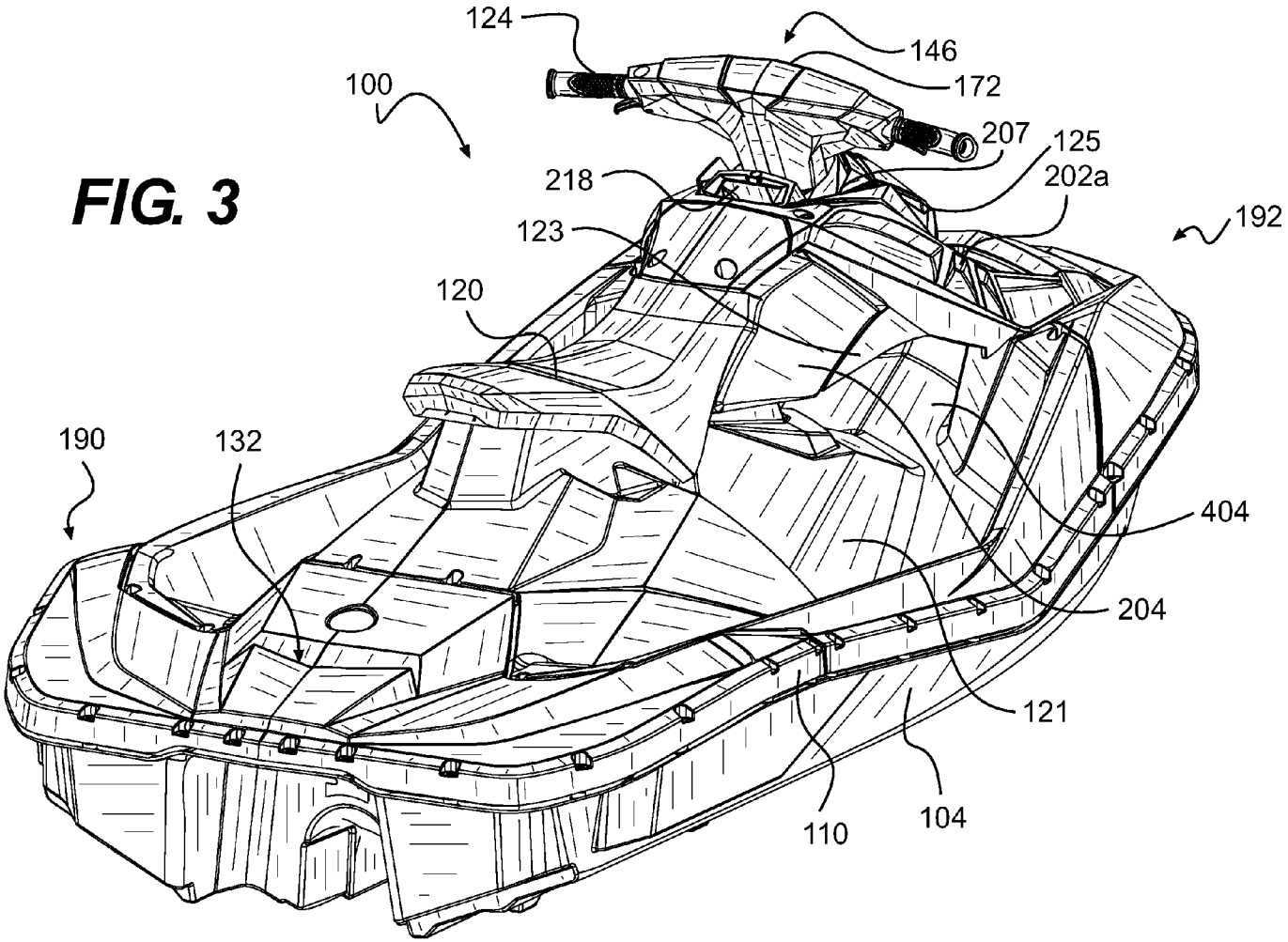
FIG. 3 is a perspective view, taken from a rear, top, right side of the personal watercraft of FIG. 2.

The deck 300 comprises several lowered portions 322 and raised portions 324. The seams 312, 314 are located along the raised portions 324. The raised portions 324 are above a predetermined water stagnation level 83 (shown in FIG. 4) of the deck 300. The water stagnation level 83 is a maximum level of water contained in the gunnels 56. As best seen in FIG. 2, a front of the middle deck portion 304 and the helm support structure 200 form a recess 406. It is contemplated that the recess 406 could be smaller than shown in the Figures, or could be omitted.

Each deck portion 302, 304, 306 is made of a unitary piece of thermoplastic. It is contemplated that one or more of the deck portions 302, 304, 306 could be constructed so as to have an opening therein (e.g. access to the engine compartment). The thermoplastic used is a composite of propylene and filler. The filler is fiberglass. It is contemplated that another type of filler could be used. The percentage of filler varies for each of the deck portions 302, 304, 306. Because the helm support structure 200 is more compact than the front portion 60 of the prior art watercraft 10, a front of the watercraft 100 is being freed (front deck portion 302) compared to the prior art watercraft 10. As a consequence, since the front deck portion 302 is not weight bearing, it can be constructed differently than the middle deck portion 304. Similarly, the rear deck portion 306 being not weight bearing, it can be constructed differently than the middle deck portion 304. The middle deck portion 304 which support most of the weight of the watercraft 100 is thus made sturdier than the front and rear deck portions 302, 306. The middle deck portion 304 is made of the thermoplastic with a percentage of filler that provides it with more structural resistance than the front and rear deck portions 302, 306. The filler of the middle deck portion 304 represents 25 percent in weight. It is contemplated that the filler for the thermoplastic of the middle deck portion 304 could represent between 20 and 30 percent in weight. The filler of the front and rear deck portions 302, 306 represents 10 percent in weight. It is contemplated that the filler for the thermoplastic of the front and rear deck portions 302, 306 could represent between 10 and 20 percent in weight. It is contemplated that the deck portions 302, 304, 306 could be made each of a different material or could be all made of the same material. It is also contemplated that the deck portions 302, 306 could have some flexibility.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A watercraft comprising:
a hull;
a deck disposed above the hull;
a helm assembly disposed above the deck, the helm assembly having:
a steering column; and
a handlebar connected to the steering column;
a pedestal disposed on the deck at least in part rearwardly of the handlebar;
a straddle seat disposed on the pedestal; and
a support structure bearing the helm assembly, the support structure surrounding at least partially the steering column, the support structure having at least one rear connection portion connected to the pedestal, the support structure having at least one front connection arm connected to at least one of the deck and the hull forwardly from the at least one rear connection portion, the support structure and at least one of the deck and the pedestal defining an aperture extending transversally through the watercraft.

2. The watercraft of claim 1, wherein the support structure includes a first portion and a second portion;
the first portion includes the at least one rear connection portion;
the first portion surrounds the steering column;
the second portion includes the at least one front connection arm; and
the first portion is connected to the second portion.

3. The watercraft of claim 1, wherein the support structure is disposed generally forward of the pedestal.

4. The watercraft of claim 1, wherein the at least one front connection arm connects to the at least one of the deck and the hull forwardly of the handlebar.

5. The watercraft of claim 1, wherein the at least one front connection arm extends forwardly from the at least one rear connection portion.

6. The watercraft of claim 4, wherein the at least one rear connection portion extends rearwardly from at least one of the handlebar and the steering column, and the at least one front connection arm extends forwardly from at least one of the handlebar and the steering column.

7. The watercraft of claim 1, wherein the at least one front connection arm includes a left connecting arm and a right connecting arm.

8. The watercraft of claim 1, wherein the support structure is removably connected to the pedestal and to the at least one of the deck and the hull.

9. The watercraft of claim 1, wherein the support structure includes at least one ventilation hose fluidly connected to an engine compartment of the watercraft.

10. The watercraft of claim 1, wherein the deck includes at least two deck portions connected to each other, each of the at least two deck portions includes at least a portion of a side of the deck in contact with the hull, and each of the at least two deck portions rest on the hull.

11. A watercraft comprising:
a hull;
a deck disposed above the hull;
a helm assembly disposed above the deck, the helm assembly having:
a steering column; and
a handlebar connected to the steering column;
a pedestal disposed on the deck at least in part rearwardly of the handlebar;
a straddle seat disposed on the pedestal; and
a support structure bearing the helm assembly, the support structure surrounding at least partially the steering column, the support structure having at least one rear connection portion connected to the pedestal, the support structure having at least one front connection arm connected to at least one of the deck and the hull forwardly from the at least one rear connection portion, the support structure including at least one ventilation hose fluidly connected to an engine compartment of the watercraft.

* * * * *